US007410451B2

(12) United States Patent
Williams

(10) Patent No.: US 7,410,451 B2
(45) Date of Patent: Aug. 12, 2008

(54) EXERCISE MACHINE ATTACHMENT

(76) Inventor: Michael Edward Williams, 2459 N. Hearthside, Orange, CA (US) 92865

( * ) Notice: Subject to any disclaimer, the term of this patent is extended or adjusted under 35 U.S.C. 154(b) by 796 days.

(21) Appl. No.: 10/993,581

(22) Filed: Nov. 19, 2004

(65) Prior Publication Data

US 2006/0111221 A1 May 25, 2006

(51) Int. Cl.
*A63B 21/00* (2006.01)
*A63B 7/00* (2006.01)

(52) U.S. Cl. ..... 482/139; 482/92; 482/99; 482/49

(58) Field of Classification Search ..... 482/32, 482/36, 51, 93, 99, 114, 120, 139, 148, 44–50; 63/12; 182/90
See application file for complete search history.

(56) References Cited

U.S. PATENT DOCUMENTS 4,161,998 A * 7/1979 Trimble ..... 182/190
5,004,228 A * 4/1991 Powers ..... 482/91
5,876,310 A * 3/1999 Mackey et al. ..... 482/74
6,370,912 B1 * 4/2002 Sutton ..... 63/12
6,422,978 B2 * 7/2002 Bouvier ..... 482/82

OTHER PUBLICATIONS

MegaFitness website: http://www.megafitness.com. Tricep Rope, 2003 (3 pages).

* cited by examiner

*Primary Examiner*—Glenn Richman
(74) *Attorney, Agent, or Firm*—Stetina Brunda Garred & Brucker

(57) ABSTRACT

An exercise machine attachment is provided wherein the attachment may comprise a hook aperture attached to a joint wherein the joint defines bead chain apertures formed within the joint and extending directionally in an oblique or perpendicular manner. The attachment may further comprise first and second bead chains attached to the bead chain apertures. Also, each bead chain may comprise a plurality of beads which are sized and configured to be ergonomically fitted into a weight lifter's hand.

1 Claim, 8 Drawing Sheets

EXERCISE MACHINE ATTACHMENT

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

The present invention relates generally to the field of exercise machines, and more particularly to an exercise machine attachment having obliquely or perpendicularly directed bead chains.

FIG. 1 illustrates a prior art tricep rope which may typically be used in conjunction with a weight lifting machine as that shown in FIG. 2. In use, the user may grasp distal ends of the rope with its hook aperture attached to a hook of the weight lifting machine. The weight lifter may then pull down on the rope distal ends to lift corresponding weights of the weight lifting machine to build the user's tricep muscles. In this exercise, it is the gripping force between the weight lifter's hands and the rope that should be used to lift the corresponding weights.

A problem associated with the prior art tricep rope is that the weight lifter's gripping force may not be sufficient to lift the corresponding weights. Instead, the user's hands may eventually slide down and abut the knobs attached to the rope distal ends. In essence, the user typically lifts the corresponding weight by pushing the knobs and not by pulling down on the rope. To properly use the tricep rope, the user must reduce the corresponding weight to match the weight lifter's gripping force. However, in doing so, the weight lifter is building his/her gripping force and not his/her tricep muscles. Hence, the prior art tricep rope may be ineffective for its intended purpose.

Another problem associated with the prior art tricep rope is that an edge of the pipe in which the rope is inserted through may cut the rope during each repetition of the exercise. In particular, the rope at its central portion rubs up against an inner edge of the pipe during each exercise repetition. Although any one such repetition may not be sufficient to cut through the whole diameter of the rope, after repetitive use, the rope may be sufficiently weakened so as to unexpectedly break.

Accordingly, there is a need in the art for an improved tricep rope.

BRIEF SUMMARY OF THE INVENTION

The present invention specifically addresses and alleviates the above-identified deficiencies in the art. These deficiencies are addressed by exercise machine attachment having first and second bead chains which extend obliquely or perpendicularly out from a joint. In particular, the exercise machine attachment of the present invention may comprise first and second chain beads, joint and hook aperture. The hook aperture may be attached to the joint and the joint may be attached to the first and second bead chains. The bead chains may comprise a plurality of beads connected end-to-end which may be rotateable about each other. The beads may each have a spherical configuration sized to approximately a golf ball size to provide an ergonomically configured and graspable surface for the weight lifter's hands. This may effectively increase a user's effective gripping force.

Further, proximal ends of the bead chains may be attached to the joint in an oblique or perpendicular manner. The angle at which the proximal ends protrude from the joint may be less than 180°, and more preferably, approximately 30°. This may alleviate any pressure between the bead chain proximal ends and the joint such that repetitive motion during use of the attachment does not cause the proximal end to rub against an edge of a joint aperture receiving the proximal ends.

BRIEF DESCRIPTION OF THE DRAWINGS

An illustrative and presently preferred embodiment of the present invention is shown in the accompanying drawings in which.

DETAILED DESCRIPTION OF THE INVENTION

Figure 1:
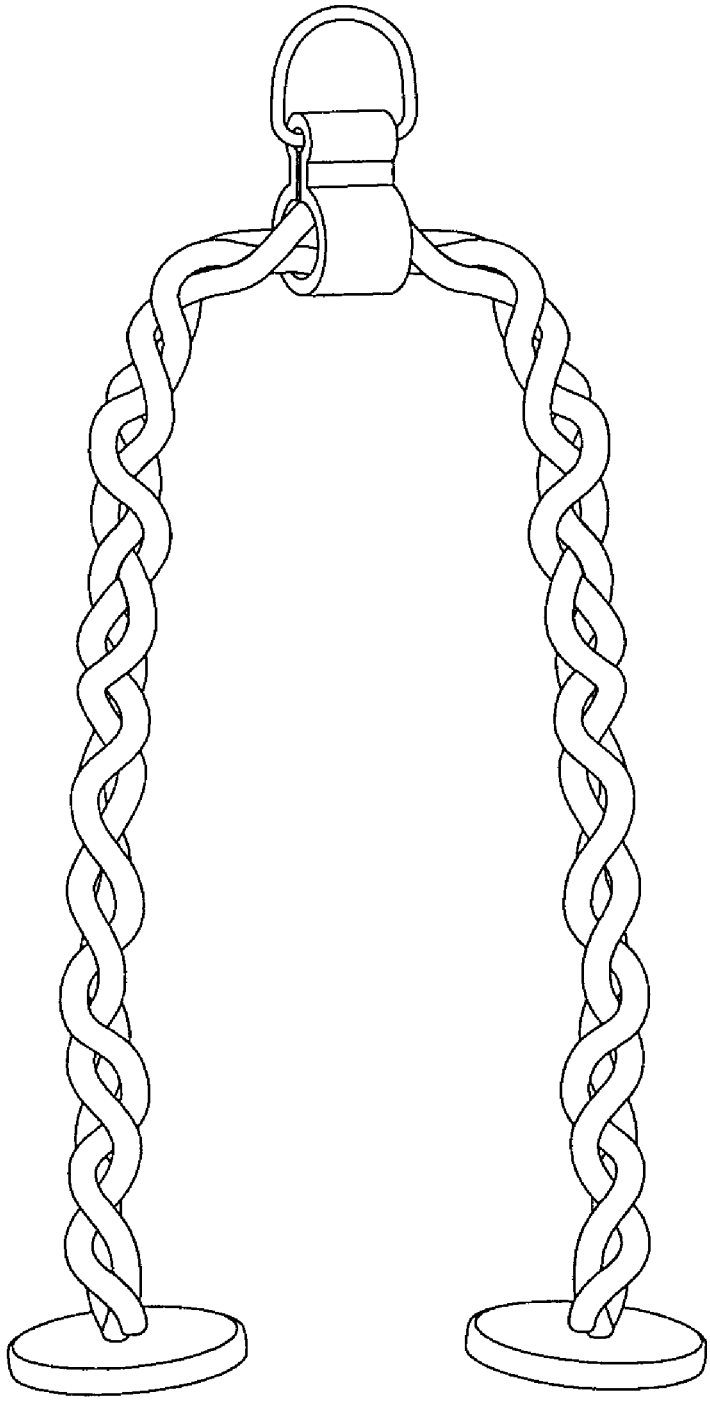
Prior Art Fig. 1
FIG. 1 illustrates a prior art tricep rope.
Figure 2:
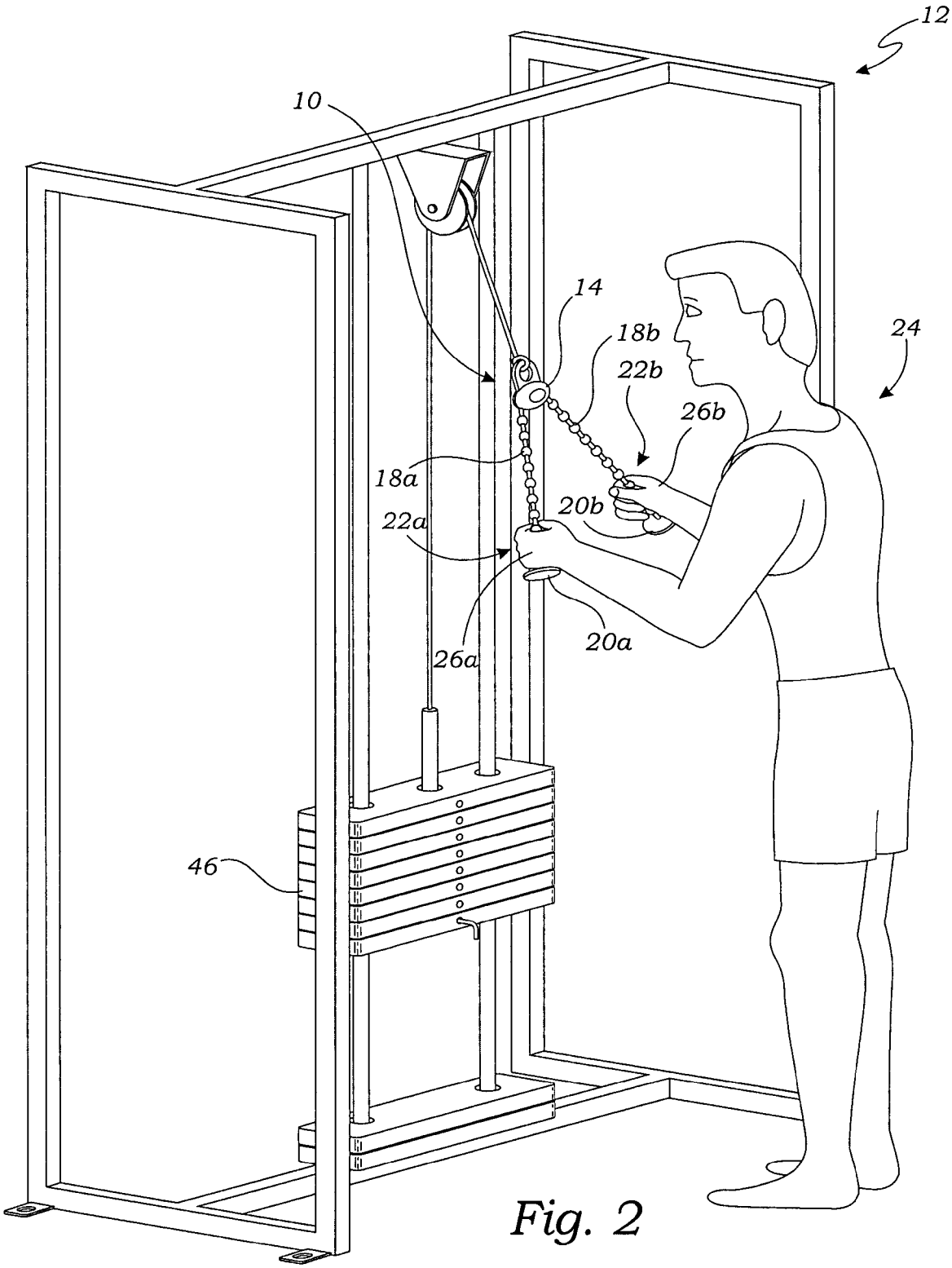
FIG. 2 illustrates an exercise machine attachment attached to a weight lifting machine, (i.e., exercise machine)

The drawings referred to herein are for the purposes of illustrating the preferred embodiments of the present invention and not for the purposes of limiting the same. For example, an exercise machine attachment 10 shown in FIG. 2 is illustrated as being attached and used in conjunction with a weight lifting machine 12 (i.e., exercise machine). Although the various aspects of the present invention are discussed herein in relation to the weight lifting machine 12, it is also contemplated within the scope of the present invention that the exercise machine attachment 10 may also be attached and used in conjunction with a rowing machine, other types of exercise machines, or other machines.

Figure 3:
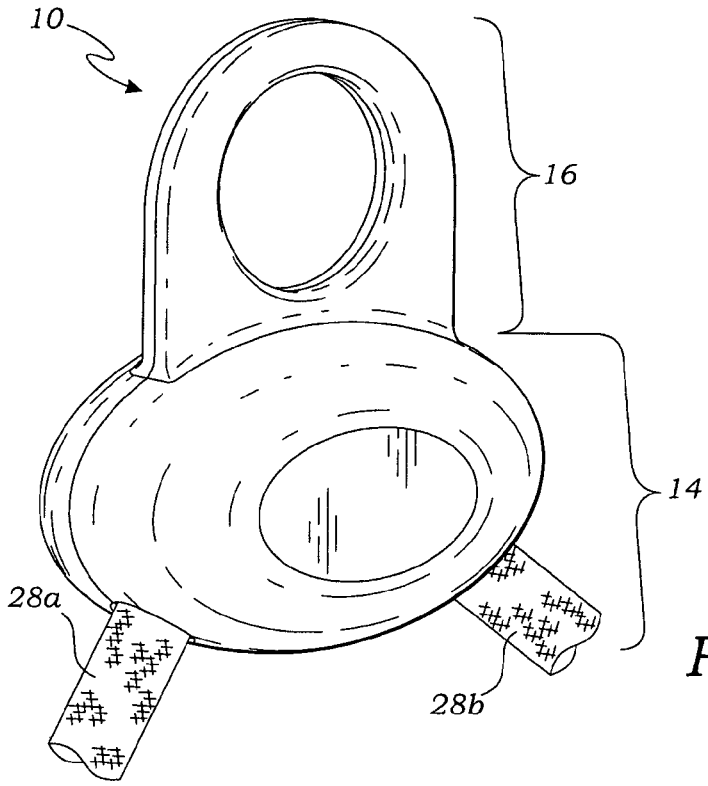
FIG. 3 is a perspective view of a joint and hook aperture of the exercise machine attachment with proximal ends of bead chains attached to the joint.

The exercise machine attachment 10 shown in FIGS. 2 and 3 may comprise a joint 14 (see FIG. 3), hook aperture 16 (see FIG. 3), first bead chain 18*a* (see FIG. 2) and second bead chain 18*b* (see FIG. 2). Further, optional rubber stoppers 20*a, b* (see FIG. 2) may be placed at distal ends 22*a, b* of the bead chains 18*a, b* so as to assist a weight lifter 24 in grasping the bead chains 18*a, b*. For example, the weight lifter's hands 26*a, b* may be abutted up against the rubber stoppers 20*a, b*.

Figure 4:
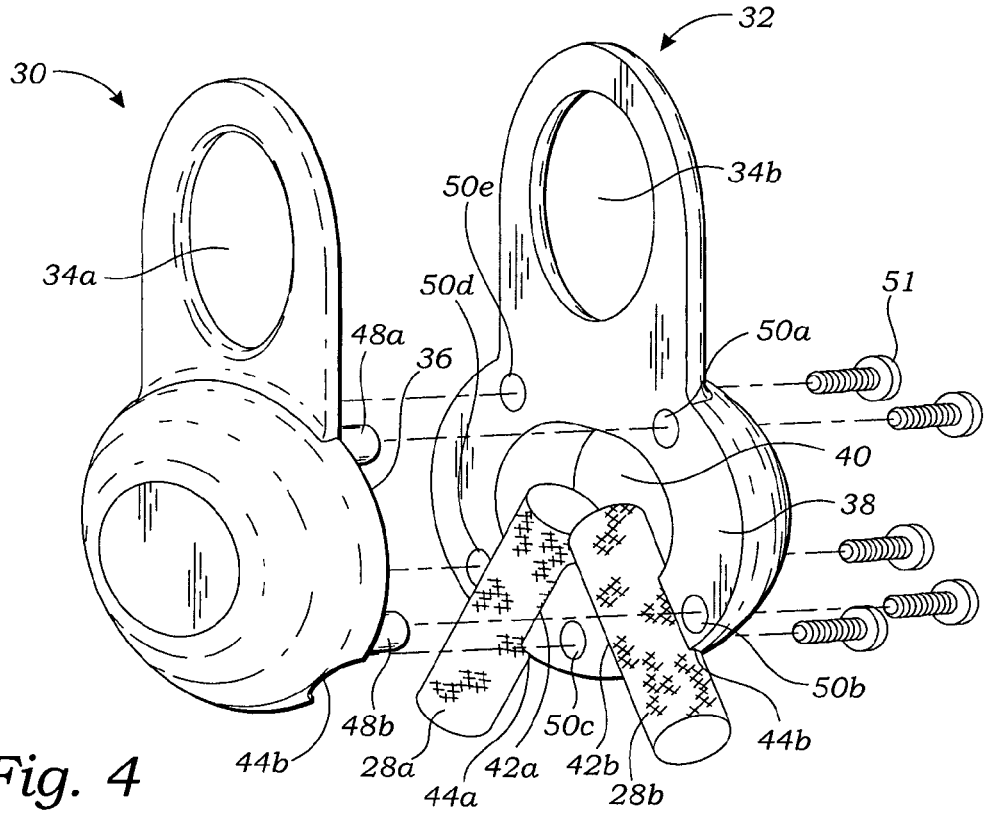
FIG. 4 is an exploded view of FIG. 3 illustrating recessed portions of the joint.

The exercise machine attachment 10 is illustrated in FIG. 3 which shows the hook aperture 16, joint 14 and proximal ends 28*a, b* of the bead chains 18*a, b* (see FIG. 2), respectively. As shown in FIG. 4, the joint 14 and hook aperture 16 may comprise a male body 30 and a female body 32. The male and female bodies may be fabricated from metal, titanium, aluminum or other hard material. The male body 30 may have a hole 34*a* having a circular configuration, but it is also contemplated within the scope of the present invention that the hole 34*a* may have other configurations such as oval, hexagonal, or octagonal. The male body 30 may also define an inner surface 36 (see FIG. 4) and may be recessed as shown in a female body inner surface 38 (see FIG. 4). The female body 32 may also have a hole 34*b* having a corresponding configuration compared to hole 34*a* of the male body 30. The female body 32 may define the inner surface 38 and may have a recessed portion 40. The female body recessed portion 40 and the male body recessed portion may be sized and configured to receive proximal ends 28*a, b* of the bead chains 18*a, b*. As shown in FIG. 4, the proximal ends 28*a, b* of the bead chains 18*a, b* may have a circular cylindrical configuration. A portion of the proximal ends 28*a, b* may reside or fit within the female body recessed portion 40 and male body recessed portion. The female recessed portion 40 and the male recessed portion may each define two channels 42*a, b* in which the proximal ends 28*a, b* are received. These channels 42*a, b* may define distal openings 44*a, b* which may further be filleted such that the proximal ends 28*a, b* are not being cut into by the openings 44*a, b*.

Further, the proximal ends 28*a, b* and female body recessed portion 40 and male body recessed portion may have a slight friction fit therebetween. The frictional forces created between the joint 14 and the bead chains 18*a, b* may be greater than the weight 46 (see FIG. 2) being lifted on the weight lifting machine 12. The female body recessed portion 40 and the male body recessed portion may also be serrated so as to further increase the frictional forces against the proximal ends 28*a, b*.

The male body 30 may further have one or more locating pins 48*a, b* which are sized, positioned and configured to be received into corresponding locating pin apertures 50*a, b* formed within the female body 32. Locating apertures 50*c-e* are also shown in FIG. 4 and may have corresponding locating pins 48 formed on the male body 30. The locating pins 48 may also have an aperture which may be internally threaded such that the locating pins 50 may be inserted into respective locating apertures 50 and the male body 30 fixedly engaged to the female body 32 via a screw or bolt 51. Alternatively, the locating pins 48 may be knurled and inserted into the locating apertures 50 or the male and female bodies may be engaged to each other through rivets. Once the male body 30 engages the female body 32, frictional forces are applied to the proximal ends 28*a, b* of the bead chains 18*a, b* by the female body recessed portion 40 and the male body recessed portion. Although the proximal ends 28*a, b* of the bead chains 18*a, b* are shown as two discrete members in FIG. 3, it is also contemplated within the scope of the present invention that the proximal ends 28*a, b* of the chains 18*a, b* may be fabricated from a unitary material.

Figure 5:
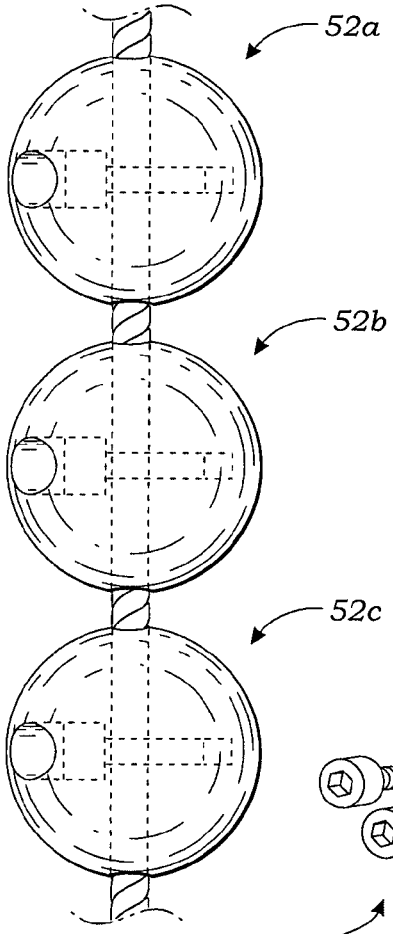
FIG. 5 is an assembled view of a plurality of beads attached to a rope.

Each of the bead chains 18*a* or 18*b* may comprise a plurality of beads 52. The bead chains may be a rope inserted through beads or may be any plurality of beads connected end to end. The beads may be fabricated from aluminum, titanium, metal, wood, plastic or steel. FIG. 5 illustrates three beads 52*a, b, c* of either bead chains 18*a* or 18*b* shown in FIG. 2. Although FIG. 5 illustrates only three beads 52*a-c*, the bead chains 18*a* or 18*b* may comprise four or more beads 52. Each bead 52 may have a substantially spherical configuration. By providing such a spherical configuration, the weight lifter 24 may more easily grasp the bead chains 18*a, b* to pull down on the exercise machine attachment 10. Additionally, the beads 52 should be sized to be hand-holdable by the weight lifter 24 so as to be a comfortable fit in the palm of the weight lifter's hand 26*a, b* and provide maximum traction to his/her hands. To further enhance the weight lifter's grip on the bead chains 18*a, b*, the bead 52 may be formed having an outer surface fabricated from an elastomeric material. The elastomeric material may provide enhanced grip to the weight lifter's hands 26*a, b*. In the alternative, a plastic or plastic/rubber hybrid material may be employed to accomplish the same, such as Santoprene or Geolast. Preferably, the outer surface of the each bead 52 is formed to feel soft and comfortable to the weight lifter's hands 26*a, b*, yet the inside is sufficiently rigid to retain its shape and configuration.

Figure 6:
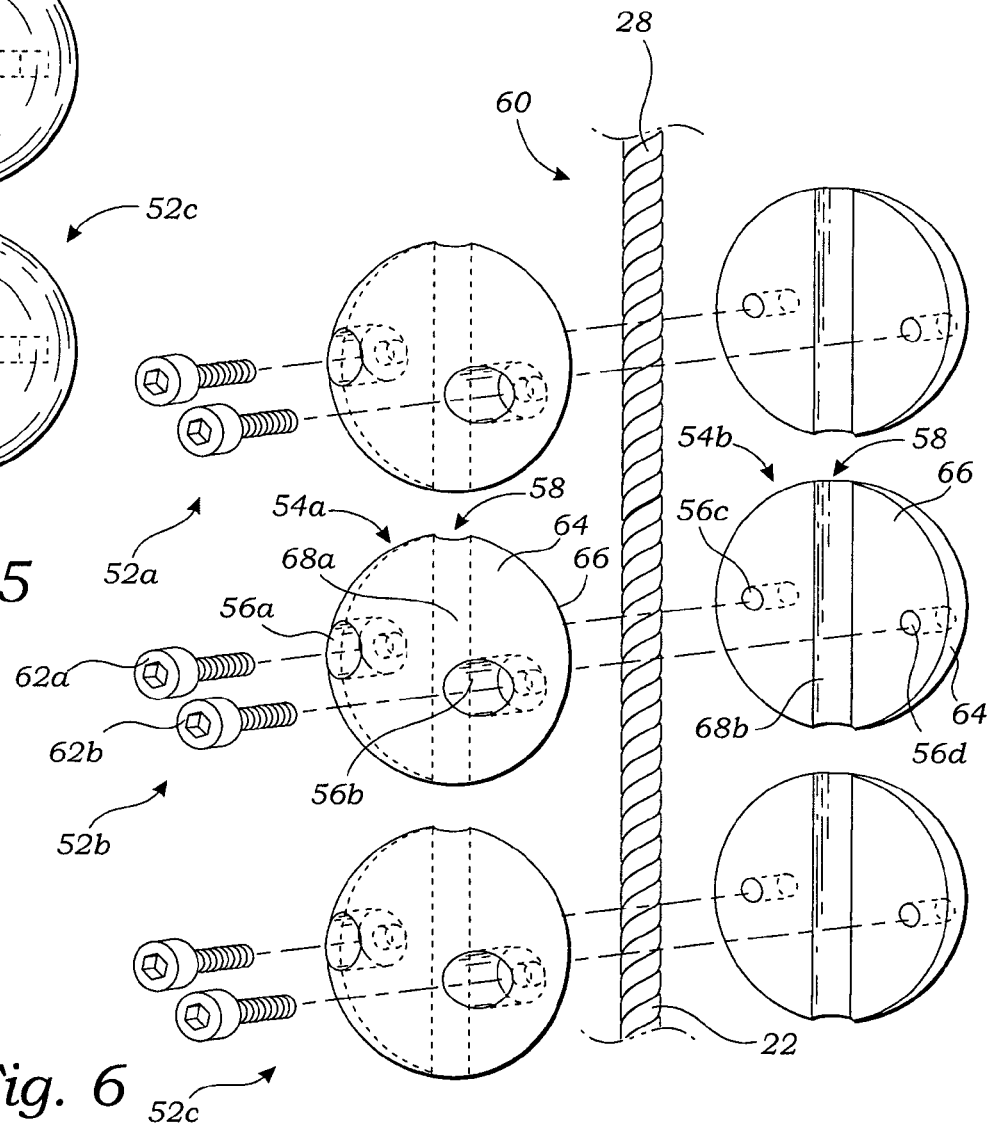
FIG. 6 is an exploded view of FIG. 5 showing the rope engaged to first and second bead portions wherein the first and second bead portions may be fixedly attached to the rope via a screw.

Referring now to FIG. 6, each bead 52*a, b, c* may be formed having first and second bead portions 54*a, b*. Each of the first and second bead portions 54*a, b* may define at least one fastener hole 56*a-d* perpendicularly formed with respect to a rope-engaging aperture 58. The first and second bead portions 54*a, b* may define the rope engaging aperture 58 and may be sized and configured to a rope 60 such that the bead 52 may be fixedly attached to the rope 60 when the first and second bead portions 54*a, b* are engaged to each other with the rope 60 inserted through the rope engaging aperture 58. Alternatively, the rope engaging aperture 58 may be sized and configured such that the bead 52 is slidable along the rope 60. This may allow the weight lifter 24 to slide unused beads 52 away from the weight lifter's hands 26*a, b* during use. The first and second bead portions 54*a, b* may be engaged to each other via fasteners 62*a, b* insertable through respective fastener holes 56*a, b* and engaged through respective threaded fastener holes 56*c, d* of the second bead portion 54*b*. This assembly of first bead portions 54*a*, second bead portions 54*b* and rope 60 may further define the proximal and distal ends 28, 22 of the bead chain 18*a* or 18*b* with the proximal ends 28 receivable into the joint 14 and the distal ends 22 attached to the optional rubber stoppers 20.

Each of the first and second bead portions 54*a, b* may have a first side 64 defining a substantially domed half-spherical surface and a second side 66 defining a substantially planar surface. The second sides 66 of the first and second bead portions 54*a, b* may define linear channels 68*a, b* through a central portion thereof. The second sides 66 of each of the respective first and second bead portions 54*a, b* may be abuttable to each other such that each linear channel 68*a* and 68*b* may be placed into contact with at least a portion of the rope 60. The linear channels 68*a, b* may preferably be formed on each of the first and second bead portions 54*a, b* as a substantially half-cylindrical cutout. The linear channels 68*a, b* formed in the first and second bead portions 54*a, b* may define the rope engaging aperture 58.

Figure 7:
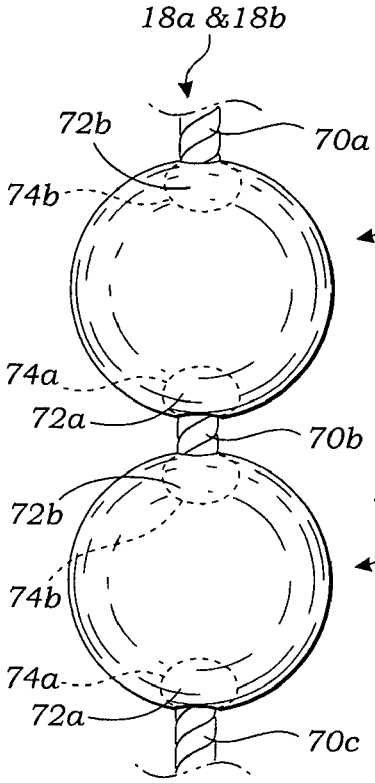
FIG. 7 is an assembled view of a plurality of beads joined together via rope segments.

In another aspect of the present invention, the bead chains 18*a, b* may be fabricated as shown in FIG. 7. In particular, a plurality of rope segments 70*a-c* connecting each of the beads 52*a, b* may be provided. The plurality of rope segments 70*a-c* may be attached to each of the beads 52*a, b* such that the rope segments 70*a-c* link the individual beads 52*a, b* together and form the bead chain 18*a, b*. Each rope segment 70*a, b, c* may have first and second bulb portions 72*a, b* that are receivable into respective bulb recesses 74*a, b* within adjacent beads 52*a, b*. This assembly of rope segments 70*a-c* and beads 52*a, b* may define the proximal and distal ends 28, 22 of the bead chains 18*a, b* with the proximal end 28 attachable to the joint 14 and the distal end 22 attachable to the optional stoppers 20. Moreover, although only two beads 52*a, b* are illustrated in FIG. 7, the bead chains 18*a* or 18*b* may comprise three or more beads 52.

Figure 8:
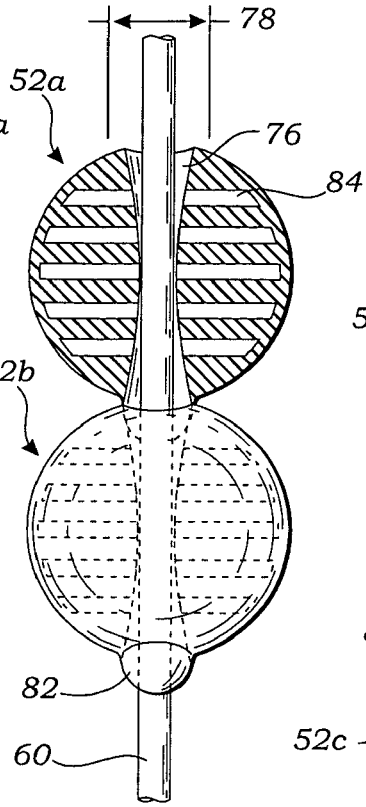
FIG. 8 is an assembled view of a plurality of beads slideably attached to a rope and illustrating male connectors engaged to adjacent female connectors.
Figure 9:
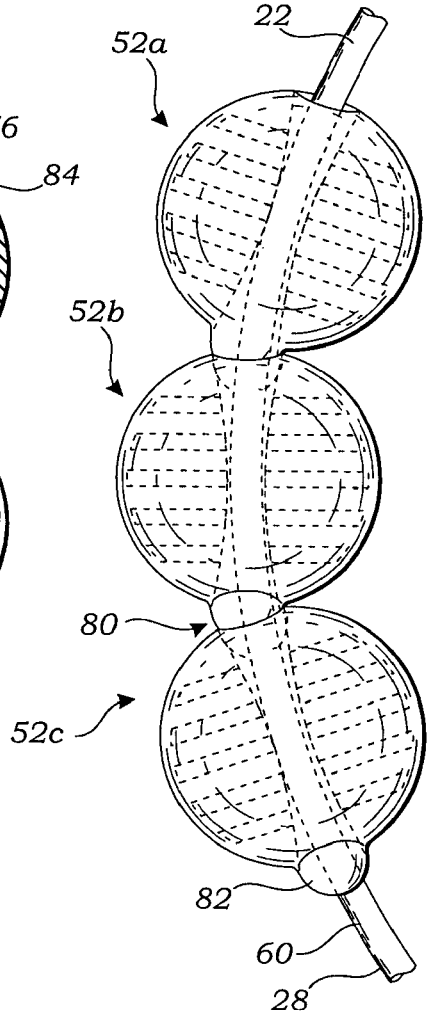
FIG. 9 illustrates the beads of FIG. 8 in a flexed position to illustrate rotating movement of the male connectors within the female connectors.

In another aspect of the present invention, the bead chains 18*a, b* may be fabricated in accordance with FIGS. 8 and 9. The beads 52*a, b, c* may have a curved or otherwise hourglass configuration 76 through a central portion 78 of each bead 52*a, b, c*. The curved configuration 76 provides play for the rope 60 to freely move therein during the full stroke of the weight lifter's hands as the chain 18*a, b* flexes, bends and twists. Each bead 52*a, b c* may be formed having female and male connectors 80, 82. By providing the female and male connectors 80, 82, gradual wear and tear of the beads 52*a-c* during continual use is reduced and/or eliminated. For example, as shown in FIG. 9, as the bead chains 18*a, b* are flexed and twisted during the exercise repetition, the male connectors 82 are inserted into the female connectors 80 and slides, twists and turns as the chain 18*a, b* slides, twists and turns. The male connectors 82 may have a substantially spherical or curved configuration so as to slide within and rotate within the female connectors 80. This assembly of beads with an hourglass configuration 76 and rope 60 may further define the proximal and distal ends 28, 22 of the bead chain 18*a* or 18*b* with the proximal ends 28 receivable into the joint 14 and the distal ends 22 attached to optional rubber stoppers 20.

The beads, as shown in FIG. 8, may have a plurality of support ridges 84 extending radially from the center portion 78 of each bead 52*a-c*. Such support ridges 84 may be formed from a hardened plastic or glass material and arranged throughout the bead 52 to provide rigidity in the core of each bead 52 while providing gripable support for the weight lifter's hands.

Figure 10:
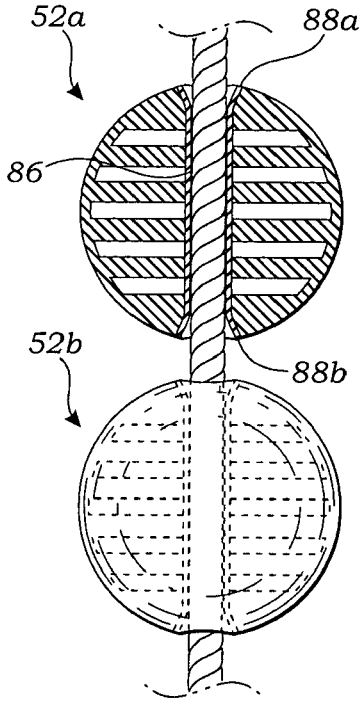
FIG. 10 is an assembled view of a plurality of beads, each bead lined with a support liner and a rope inserted therein.

In another aspect of the present invention, the bead chains 18*a, b* may be fabricated in accordance with FIG. 10. As shown in FIG. 10, the rope engaging aperture 58 may further have a support liner 86 formed from a substantially rigid metallic material, e.g., aluminum or steel to insure rigidity of the bead 52. The support liner 86 is preferably cylindrical in shape complimentary to the size and shape of the rope engaging aperture 58. The support liner 86 may be formed having flanged ends 88*a, b* which provide play at each end 88*a, b* of the bead 52*a, b* to allow flexure of the bead chains 18*a, b* during use by the weight lifter 24.

Figure 11:
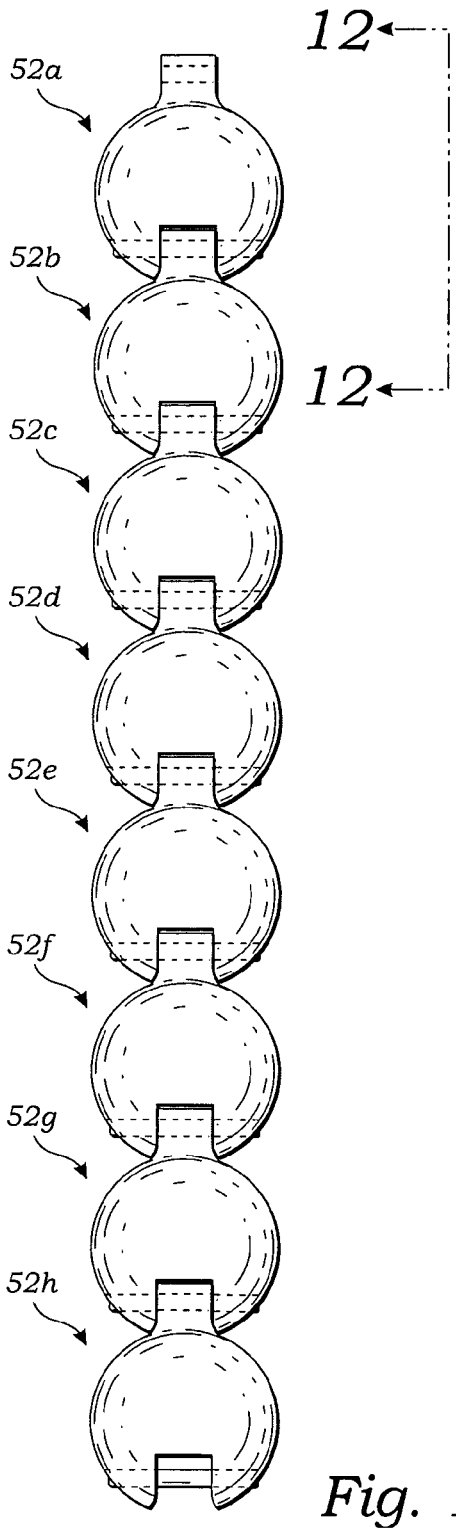
FIG. 11 is an assembled view of linkable beads.
Figure 12:
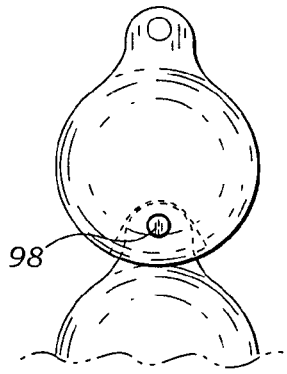
FIG. 12 is a side view of two linkable beads of FIG. 11.
Figure 13:
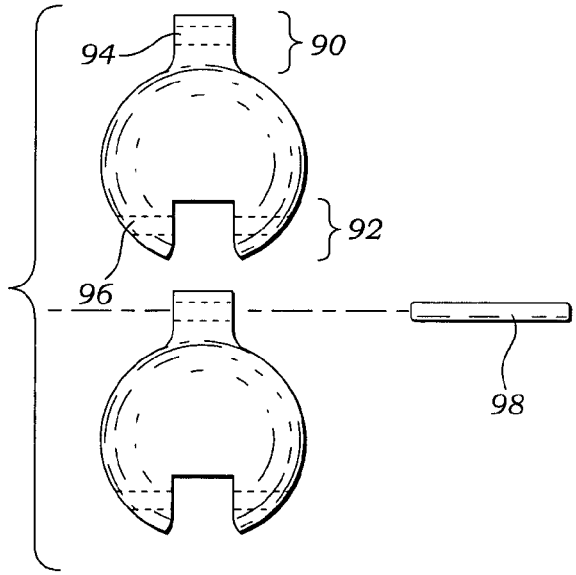
FIG. 13 is an exploded view of the linkable beads illustrating pivotable engagement between adjacent beads via a link plug.

In another aspect of the present invention, the bead chains 18*a, b* may be fabricated in accordance with the embodiment shown in FIGS. 11-13. These beads 52*a-h* are linkable and may be linked to form the bead chains 18*a, b*. Each linkable bead 52*a-h* may define male and female link ends 90, 92 (see FIG. 13). The male link end 90 may also form a substantially cylindrical-shaped male link aperture 94 and the female link end 92 may have formed therein a substantially cylindrical-shaped female link aperture 96. The male link end 90 may be insertable into the female link end 92 (see FIGS. 11 and 12) and retained therein via an independent link plug 98. The link plug 98 may be insertable through the female link aperture 96 and through the male link aperture 94 so as to allow the linked beads 52 to be detachably engageable to each other and pivotable about each other.

The linked beads 52 may also be attached to rope 60 to define the bead chain proximal end 28. The proximal end 28 may be attached to the joint 14. The linked beads 52 may also be attached to optional rubber stoppers 20.

Figure 14:
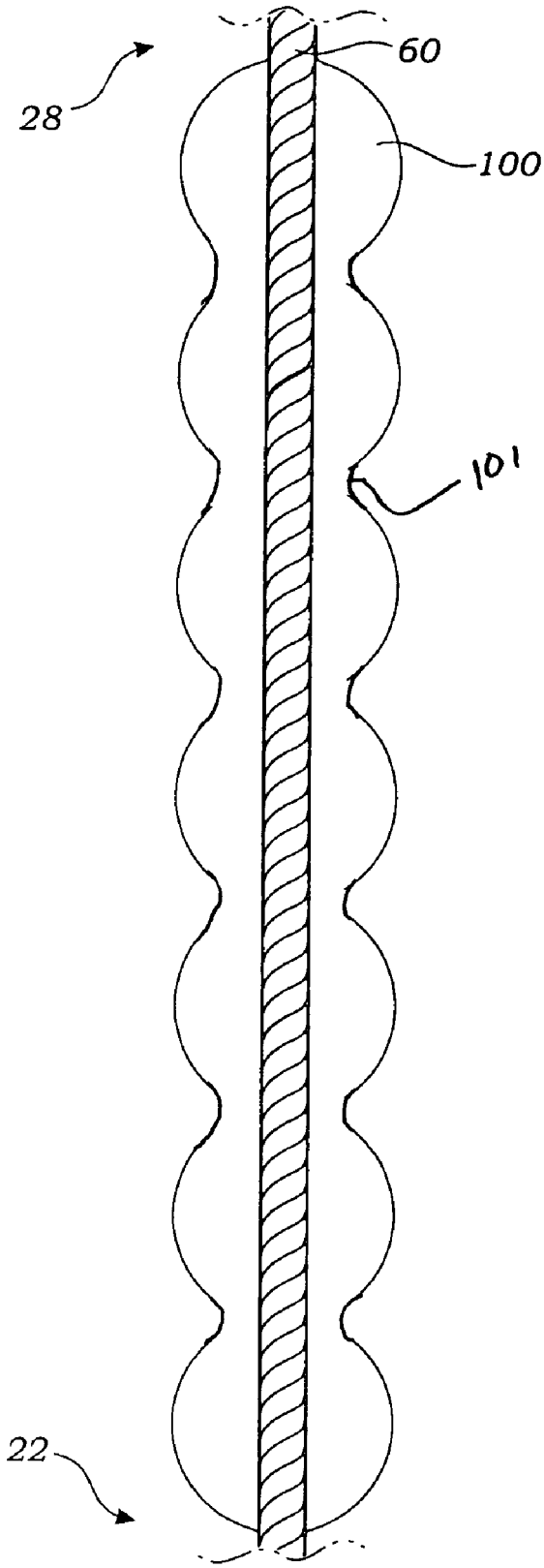
FIG. 14 illustrates a rope with an elastomeric material formed over the rope and having a configuration similar to the plurality of beads.

In another aspect of the present invention, as shown in FIG. 14, the bead chains 18*a, b* may each comprise the rope 60 and a unitary resilient body 100 (e.g., elastomeric material) formed on the rope 60. The resilient body 100 may be molded over the rope. Also, the resilient body 100 may be sufficiently rigid to allow the weight lifter's hands 26*a, b* to grasp the exercise machine attachment 10 and pull the same without feeling any significant stretching thereof. The resilient body 100 may also define an outer surface 102 which may have a plurality of substantially spherical configurations resembling the beads 52. The valleys 101 may be sized and configured such that the valleys 101 do not pinch the hand of the user. The proximal end 28 may be attached to the joint 14 and the distal end 22 may be attached to optional rubber stoppers 20

Figure 15:
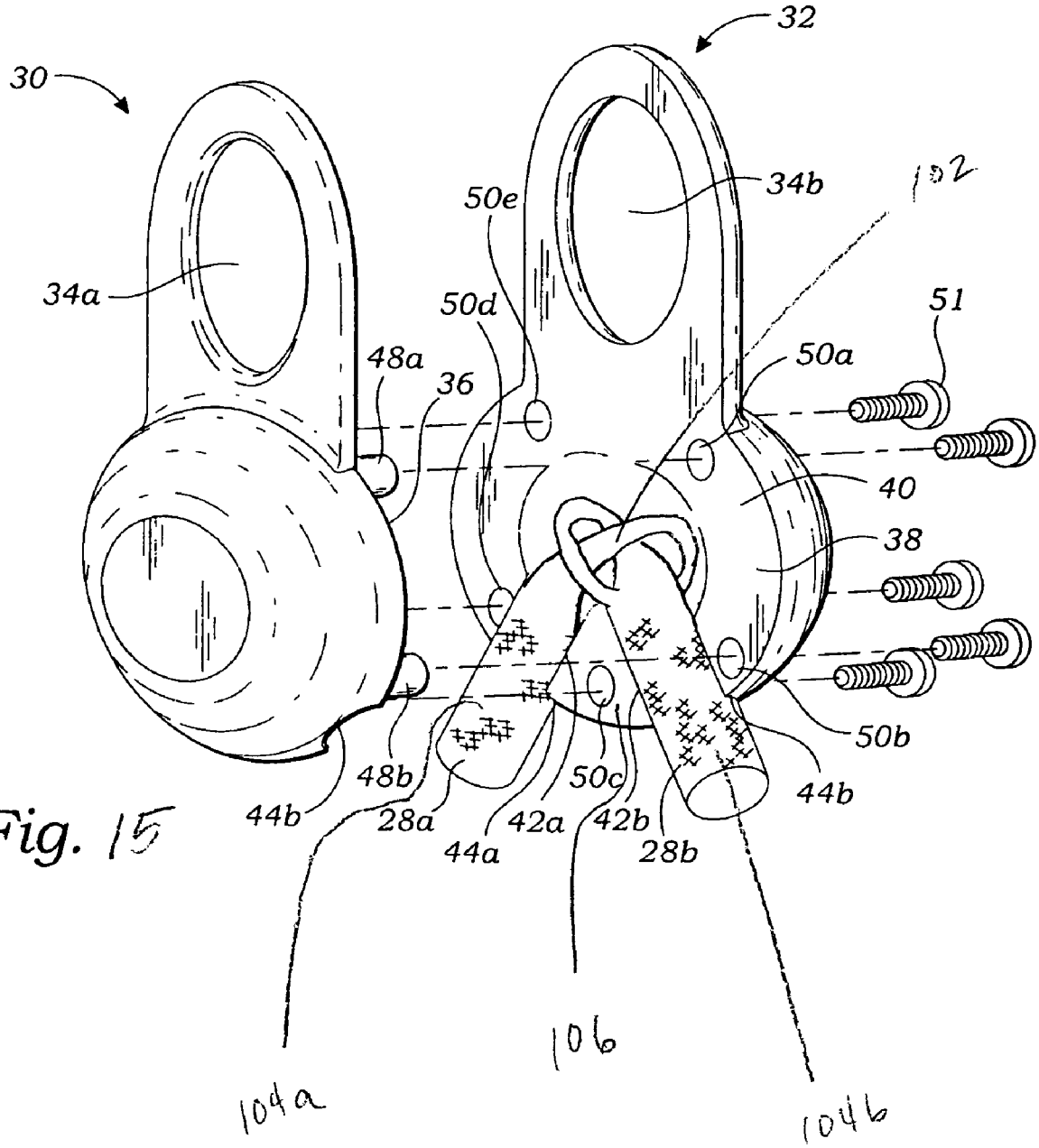
FIG. 15 illustrates an enlarged medial portion inserted into an internal cavity of the joint.

In another aspect of the present invention, a rope 60 may define a medial portion 102 and two distal portions 104*a, b*. The medial portion 102 may be enlarged compared to the two distal portions 104*a, b*. For example, the medial portion 102 of the rope 60 may be tied into a knot, as shown in FIG. 15. Or in the alternative, the medial portion 102 may have a ring slid over the medial portion 60 and swedged thereon to form a ball swedge. The medial portion 60 may be placed or inserted into the internal cavity 40 of the joint and the distal portions 104*a, b* may be received by the channels 42. This arrangement of the enlarged medial portion 60 inserted into the internal cavity 40 of the joint 14 may prevent the rope 60 from sliding left to right creating a rubbing action against a bottom portion 106 of the joint 14.

This description of the various embodiments of the present invention is presented to illustrate the preferred embodiments of the present invention, and other inventive concepts may be otherwise variously embodied and employed. The appended claims are intended to be construed to include such variations except insofar as limited by the prior art.

What is claimed is:

1. An exercise machine comprising:

a. a frame;

b. a plurality of selectable weights attached to the frame for changing a resistance of the exercise machine;

c. a hook;

d. a cable defining first and second distal ends, the first distal end being attached to the weights and the second distal end being attached to the hook;

e. a pulley attached to the frame, the pulley sized and configured to receive the cable;

f. an exercise machine attachment attached to the hook for pulling the cable and lifting selected weights, the attachment comprising:

i. a joint defining first and second bead chain recesses;

ii. first and second bead chains each sized and configured to be graspable within a hand of the weight lifter and respectively engageable to first and second bead chain recesses, each bead chain comprising a plurality of beads connected end to end; and iii. a hooking aperture engaged to the joint and to the hook for affixation of the attachment to the exercise machine.

* * * * *